US005749813A

United States Patent [19]

Domzalski

[11] Patent Number: 5,749,813

[45] Date of Patent: May 12, 1998

[54] EXERCISING MACHINE WITH DIRECT DRIVE TO WEIGHT STACK

[75] Inventor: Ken Domzalski, Milford, Pa.

[73] Assignee: 3266974 Canada Inc., Boucherville, Canada

[21] Appl. No.: 675,474

[22] Filed: Jul. 5, 1996

[51] Int. Cl.[6] ..... A63B 21/06

[52] U.S. Cl. ..... 482/97; 482/137

[58] Field of Search ..... 482/94, 97, 98–100, 482/133, 136, 137, 138

[56] References Cited

U.S. PATENT DOCUMENTS

| | | | |
|---|---|---|---|
| 3,116,062 | 12/1963 | Zinkin | 482/97 |
| 4,236,712 | 12/1980 | Lambert, Jr. | 482/98 |
| 5,100,128 | 3/1992 | Mabry et al. | 482/137 X |

*Primary Examiner*—Richard J. Apley
*Assistant Examiner*—John Mulcahy
*Attorney, Agent, or Firm*—Swabey Ogilvy Renault

[57] ABSTRACT

An exercising machine with a direct drive to the weight stack is described. It comprises a support frame having a seat to accommodate a user person. A weight stack is provided and has a plurality of predetermined weight elements which are guidingly connected to a pivoting support platform. Restraining guide rods are secured to the pivoting support platform to permit the weight elements to be displaced therealong in a predetermined stack form. An elongated carrier rod extends freely through the weight stack and has a plurality of attachment holes along a prescribed length thereof. A connecting pin secures a selected one of the weight elements to one of the attachment holes of the carrier rod to form the predetermined stack. A pivotal connecting linkage is secured to the carrier rod and to a pivoting exercising frame engageable by a user person to perform an exercise. The predetermined stack is displaced along the restraining guide rods during a pivoting displacement of the pivoting exercising frame while the pivoting support platform and pivotal connecting linkage pivot whereby to accommodate an arcuate displacement of the rear end portion of the pivoting exercising frame when displaced about a pivotal connection.

6 Claims, 6 Drawing Sheets

EXERCISING MACHINE WITH DIRECT DRIVE TO WEIGHT STACK

TECHNICAL FIELD

The present invention relates to an exercising machine having a direct drive to the weight stack and wherein the weight stack and the pivoting exercising frame are interconnected through a pivotal connecting linkage accommodating an arcuate displacement of a pivoting end connection of the exercising frame when displaced about its pivot.

BACKGROUND ART

A multitude of exercising machines are known whereby to exercise various muscles or muscle groups of the human body. There are many different classes of these machines ranging from amateurish construction to professional exercisers. This higher class of machines are very expensive to construct and not affordable to the majority of people. Also, many of these exercising machines use steel cables and pulleys to connect a weight stack to a user engaging exercising element. In most devices it is also necessary to adjust the position of a seat whereby to adapt the machine to the stature of the user person and this is often difficult to do and is time-consuming.

A disadvantage of the cable and pulley linkage is that often the cables will fall off the pulleys and the cable jams between the pulley support flanges and the pulley wheel and often disabling the exercising machine for long periods of time before they can be repaired. A further disadvantage is that a cable and pulley connection can cause injury to the user and when the cable is broken it takes even longer for the machine to be repaired. A still further disadvantage of the professional-type machines is that they are expensive and not affordable to most people for home use.

SUMMARY OF INVENTION

A feature of the present invention is to provide an exercising machine with a direct drive to the weight stack and wherein there are no pulleys or cables and wherein the machine is simple in construction, effective in muscle exercising, easy to adjust and which substantially overcomes the above-mentioned disadvantages of the prior art.

Another feature of the present invention is to provide an exercising machine with direct drive to the weight stack and wherein a pivoting exercising frame is pivotally connected to the weight stack through a pivotal connecting linkage which permits the weight stack to pivot and compensate for the arcuate displacement of the connected end of the exercising frame.

Another feature of the present invention is to provide an exercising machine with a direct drive to the weight stack and wherein a stationary seat is secured to the support frame at one end of the machine and wherein the adjustment of the exercising device is effected by adjusting a pivotal connecting linkage which is secured to a weight stack at another end making the machine highly compact.

According to the above features, from a broad aspect, the present invention provides an exercising machine comprising a support frame having a seat to accommodate a user person. A weight stack having a plurality of predetermined weight elements is guidingly connected to a pivoting support platform. Restraining guide means is secured to the pivoting support platform to permit the weight elements to be displaced along the guide means in a predetermined stack form. An elongated carrier means extends freely through the weight stack and has a plurality of attachment points along a prescribed length thereof. Connection means secures a selected one of the weight elements to one of the attachment points to form the predetermined stack. A pivotal connecting linkage is secured to the carrier means and pivotally connected to a rear end portion of a pivoting exercising frame engageable by a user person to perform an exercise. The pivoting exercising frame has a pivotal connection to a frame member intermediate the weight stack and the seat. The pivoting exercising frame further has a user engagement means in a front portion thereof and disposed relative to the seat. The predetermined stack is displaced along the restraining guide means during a pivoting displacement of the pivoting exercising frame about the pivotal connection while the pivoting support platform and pivotal connecting linkage pivot to accommodate an arcuate displacement of the rear end portion of the pivoting exercising frame when displaced about the pivotal connection.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
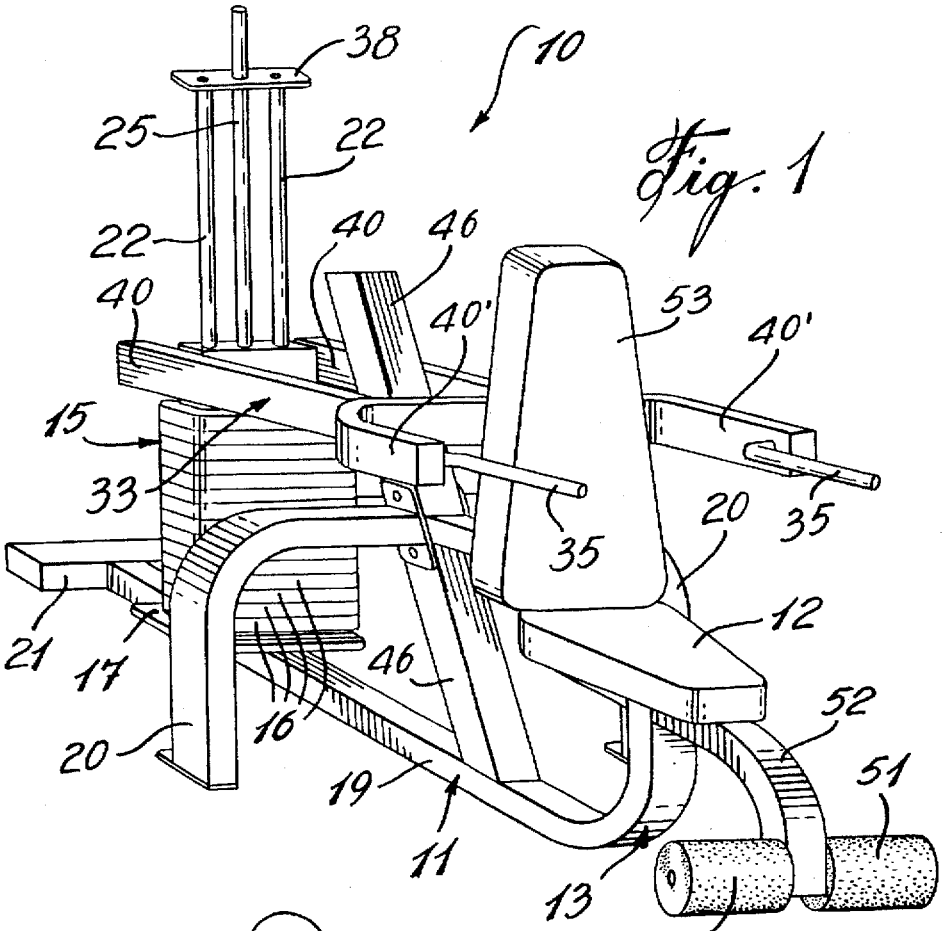
FIG. 1 is a perspective view of an exercising machine constructed in accordance with the present invention to perform triceps muscle exercises.
Figure 2:
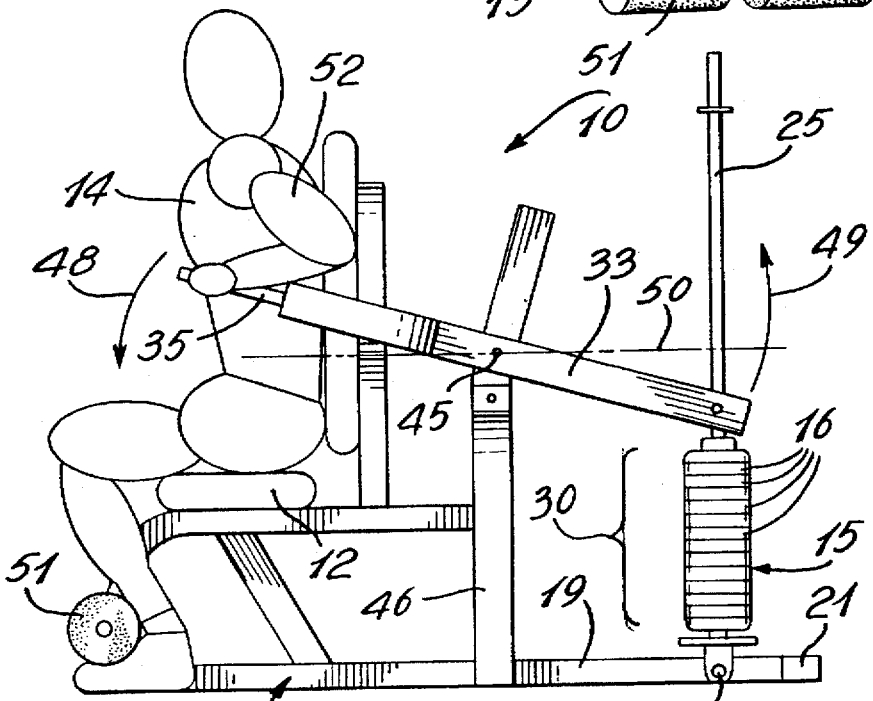
FIG. 2 is a side view of FIG. 1.

Referring now to the drawings and more particularly to FIGS. 1 and 2, there is shown generally at 10 an exercising machine constructed in accordance with the present invention. As hereinshown the machine 10 comprises a support frame 11 having a seat 12 secured at a forward end 13 of the frame whereby to accommodate a user person 14 as shown in FIG. 2. A weight stack 15 comprised of a plurality of predetermined weight elements, herein rectangular steel discs 16 is connected to a pivoting support platform 17 which is pivotally secured by the pivot connection 18 to the base member 19 of the support platform 11.

The support platform is stabilized by a pair of legs 20 and a transverse arm 21 secured at the rear end of the base member 19.

Figure 3:
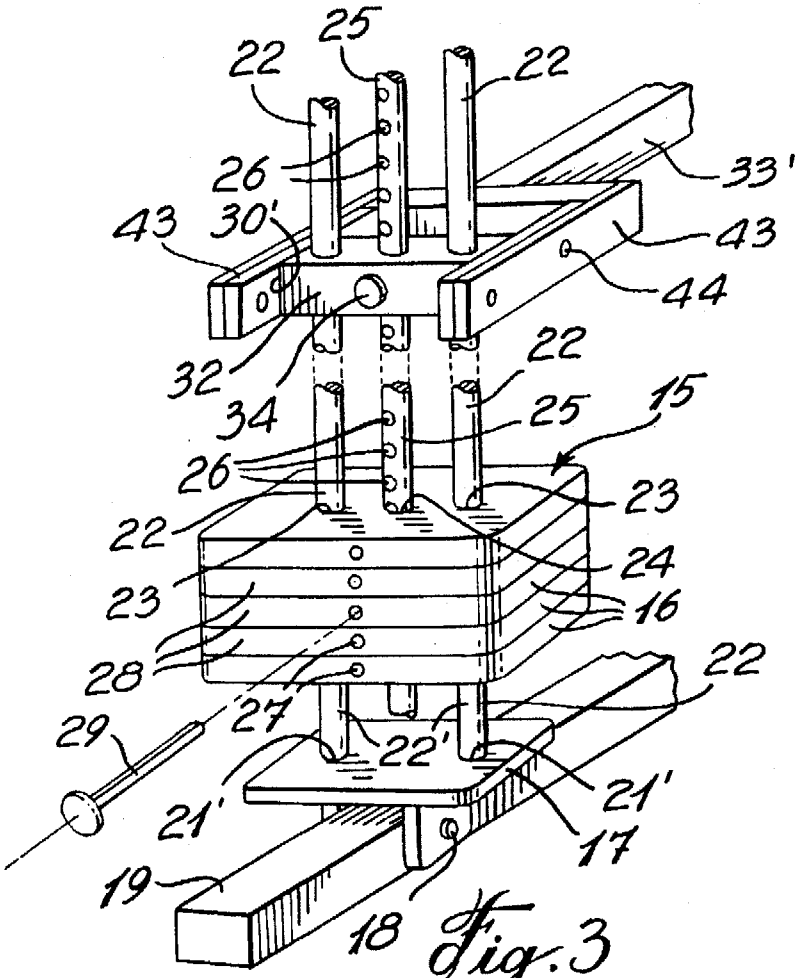
FIG. 3 is a fragmented perspective view showing the construction of the weight stack mechanism and the pivotal connecting linkage which is secured to the pivoting exercising frame.

With additional reference to FIG. 3, it can be seen that the weight stack 15 is guidingly restrained in position over the pivotal support platform 17 by a pair of restraining guide rods 22 which are connected at a lower end 22' to the pivotal support platform 17 and extend through the stack of discs 16 into respective guide holes 23 disposed on each side of a central aperture 24 provided in each of the discs 16 and through which freely extends an elongated carrier rod 25 which is provided with a plurality of attachment points, herein constituted by spaced apart holes 26, which are positioned and dimensioned for facial alignment with a selected one of a through bore 27 provided in a side wall 28 of each of the rectangular weight discs 16. Connection means in the form of a connecting pin 29 is disposed in a selected through bore 27 and an aligned one of the holes 26 whereby to secure a predetermined stack of discs 16, such as the stack 30 as shown in FIG. 2 and comprising a plurality of discs 16 disposed on top of the selected disc 16'. This selected stack represents a predetermined exercising weight, as is well known in the art.

A pivotal connecting linkage 31 which consists of a connecting block 32 is also secured to a selected one of holes 26 provided in the elongated carrier rod 25 whereby to adjust the position of a pivoting exercising frame 33 which is engageable by the user person 14 to perform a muscle exercise. A further connecting pin 34 secures the connecting block 32 at a desired position so that the handles 35 which extend to each side of the seat 12 are disposed at a convenient height for the user person 14.

The connecting block 32 is provided with through bores 36 through which the restraining guide rods 22 extend freely. It also has a central aperture 37 for the free passage of the elongated carrier rod 25 to permit adjustment of the pivotal exercising frame 33. As hereinshown, the carrier rod 25 and the opposed restraining guide rods 22 extend parallel to one another and are maintained in this position by the holes 23 and aperture 24 and by an end bracket 38 which is secured to the ends of the restraining guide rods 22 and which is provided with a central aperture 39 for the free passage therethrough of the elongated carrier rod 25. The connecting block 32 is further pivotally connected at its ends 30' between a pair of parallel frame members 40 of the pivotal exercising frame 33, as shown in FIGS. 1 and 2. As shown in FIG. 3, a single pivoting exercising frame 33' is provided with a fork 42 at a free end thereof and having side arms 43 to provide a pivotal connection of the connecting block 32 adjacent the ends 30'. Pivot pin 44 provides the pivotal connection.

Accordingly, the exercising machine of the present invention has a support frame with a seat 12 located at a front end and a weight stack 15 supported adjacent a rear end. A pivoting exercising frame 33 or 33' has a pivotal connection 45 to a frame member 46 which is disposed between the seat 12 and the weight stack. The pivoting exercising frame 33 or 33' is directly connected to the weight stack by the parallel arms 40 which connect to parallel side arms 40' extending to each side of the backrest 46. This provides direct connection between the handles 35 and the weight stack.

As shown in FIG. 2, during an exercising motion where the handles 35 are depressed downwardly in the direction of arrow 48 the rear portion of the pivoting exercising frame 33 will pivot upwardly along an arc, as shown by arrow 49, and resting on its pivotal connection 45. This causes the pivoting support platform 17 to pivot or tilt rearwardly and at the same time the connecting block 32 also pivot about its pivot pin connection 44, whereby to accommodate the arcuate displacement of the pivoting exercising frame.

As previously described, and with reference to FIG. 2, the pivotal connecting linkage or connecting block 32 is adjustably secured along the carrier rod 25 whereby to vary the position of the arms 35 relative to the seat 12. As hereinshown if, for example, the pivot block was to be secured on the axis 50, the pivotal exercising frame 33 would lie substantially on a horizontal axis thereby lowering the arms 35. Accordingly, there is provided a simple adjustment means and there are no pulleys or cables to connect the arms 35 to the selected weight stack 30. The exercising machine example as shown in FIGS. 1 and 2 also provides a pair of feet restraining roller pads 51 spaced forwardly of the seat 12 on a depending frame member 52 secured to the support frame 11. This exercising machine 10 is designed to exercise the biceps and triceps muscles 52 of the user person.

This exercise works the triceps muscle which makes up two-thirds of the upper arm. This exercise will also stimulate the chest and shoulder muscles. The user person is in the seated position with his feet locked under the roller pads 51. The user grasps the lever arm handles 35 and presses the lever in a downward motion. The lever arm 40' will travel approximately below the waist area where the triceps are forced into a locked straight arm position. this is the contracted position. The lever arm 40' is then returned to its starting position and repeated.

Figure 4:
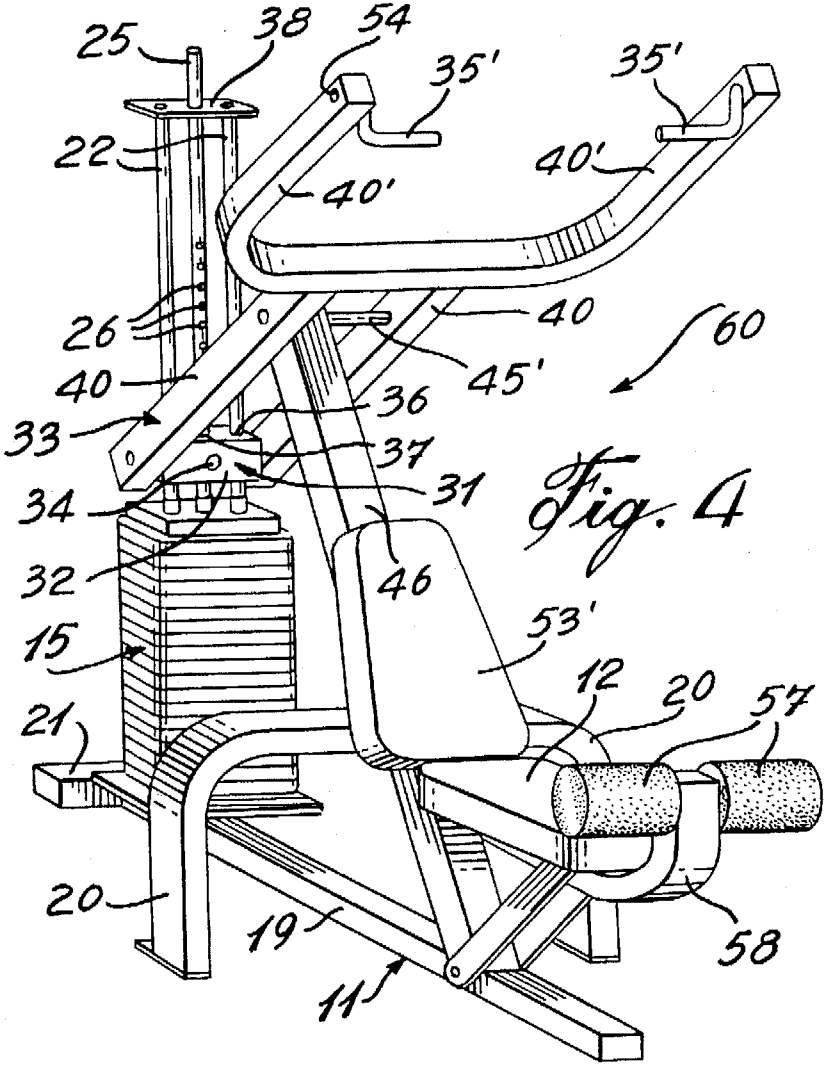
FIG. 4 is a perspective view showing an exercising machine constructed in accordance with the present invention for lateral muscle exercising.
Figure 5:
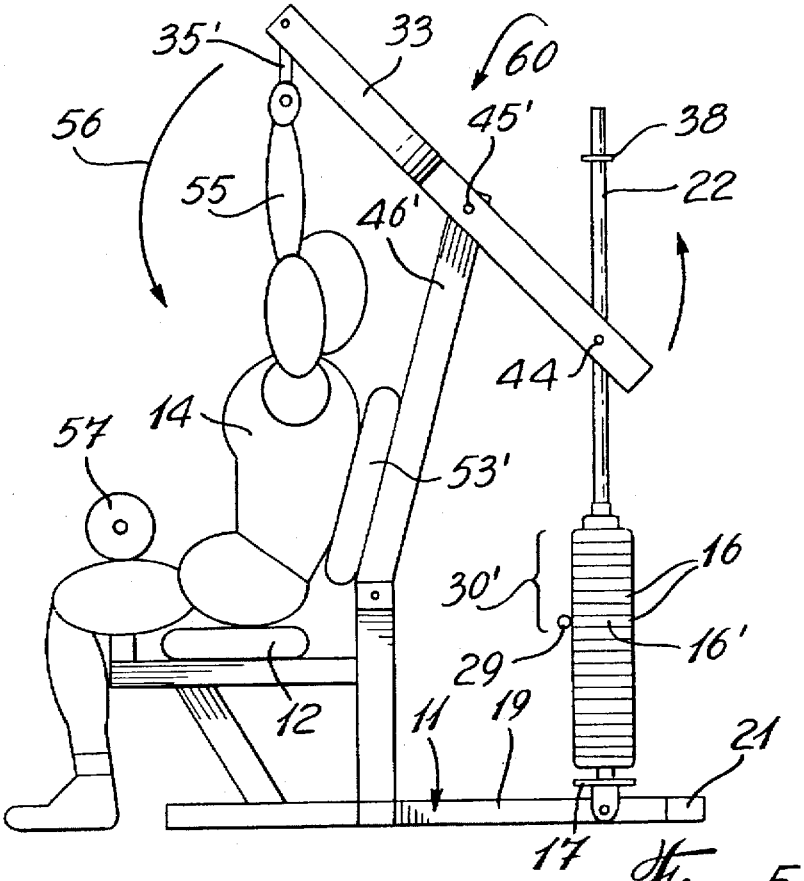
FIG. 5 is a side view of FIG. 4.

FIG. 4 shows a machine similar to that illustrated in FIGS. 1 and 2 but as hereinshown the frame member 46' extends higher behind the backrest 53' which is hereinshown secured rearwardly inclined on the rearwardly inclined frame member 46'. As also shown herein the pivotal connection 45' has also been moved higher. Furthermore, the handles 35' are hereinshown as being connected to the parallel side arms 40' by pivot connections 54. This permits the user person 14, as shown in FIG. 5 to extend his arms 55 in a fully extended upward position and to pull on the pivotal exercising frame 33 downwardly in the direction of arrow 56 causing the weight stack 30' to be drawn by the connecting block 32 which is connected higher up on the elongated carrier rod 25. Leg restraining roller pads 57 are secured on an upwardly curved frame member 58 which extends forwardly from the seat 12 to a predetermined distance thereabove. This exercising machine as generally indicated by reference numeral 60 constitutes a lateral muscle exerciser.

The lateral pull exercise primarily trains the entire region of the back. It also provides secondary muscle stimulation to the biceps. The user is placed in a seated position with back support during the movement. The legs are held down in place with the roller pads 52. The user grasps both handles 35' and pulls the lever into the chest area thus contracting the muscles of the back. The lever arm 40' is returned to the starting position and repeated through a number of repetitions. The lever controls the movement throughout ensuring perfect form.

Figure 6:
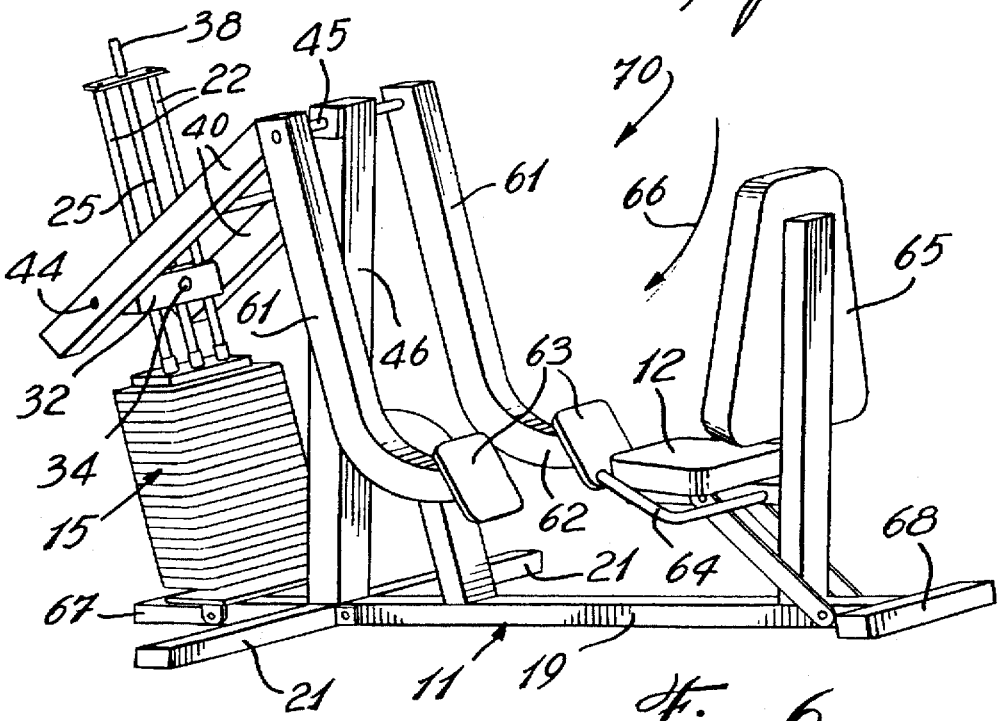
FIG. 6 is a perspective view of an exercising machine constructed in accordance with the present invention for leg muscle exercising.

FIG. 6 shows a still further version of the exercising machine of the present invention. The machine 70 is a leg exercising machine and as hereinshown the parallel frame members 40 have a pair of depending forward arms 61 which are connected to a respective one of the parallel frame members 40 and extend from the pivotal connection 45 secured to the frame member 46. The depending arms 61 have a downwardly curved portion 62 at the end of which is secured a respective foot plate 63. The position of these foot plates 63 is adjusted by displacing the connecting block 32 along the carrier rod 25 and engaging it at a desired position therealong with the use of the pivot pin 34, as previously described. Handles 64 are provided to each side of the seat 12. The backrest 65 is now located in facing relationship to the weight stack 15. This provides restrainment of a user person sitting on the seat and pushing downwardly against the foot plate 63, in the direction of arrow 66, while holding onto the handles 64. As hereinshown the support frame 11 is provided with an extension frame member 67 at a rear end thereof and a further transverse T-shaped frame member 68 at the front end or the user end.

Figure 7:
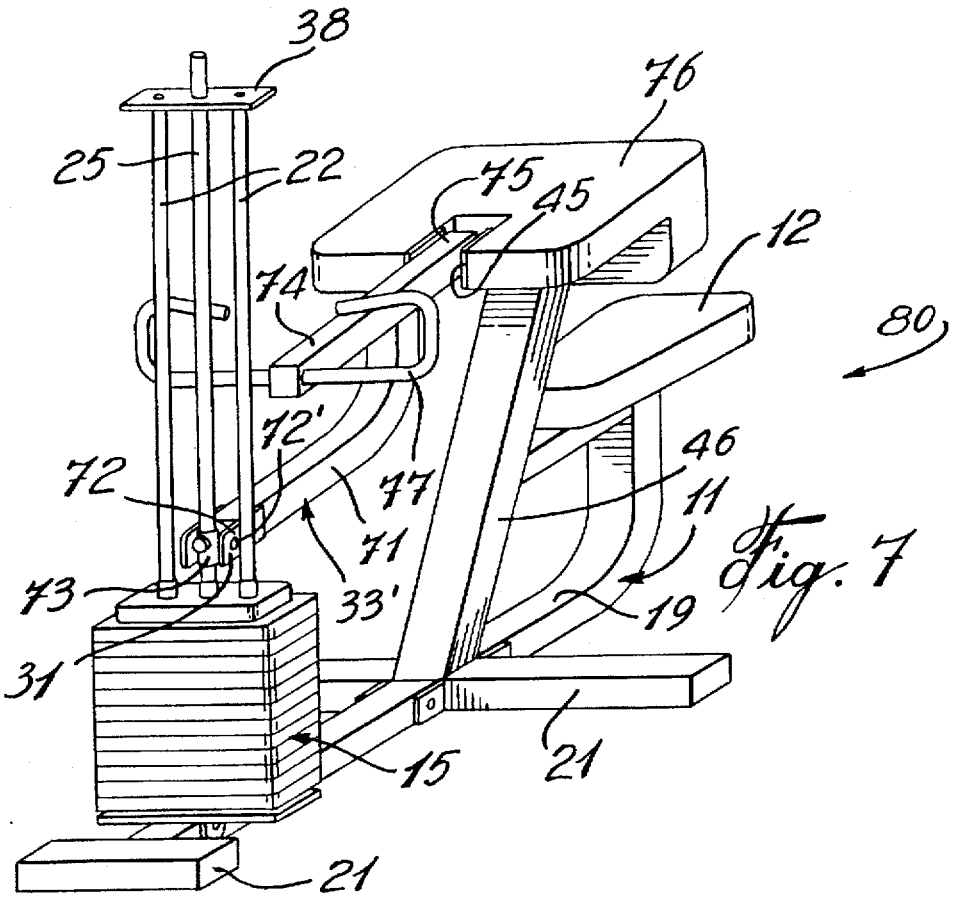
FIG. 7 is a perspective view of an exercising machine constructed in accordance with the present invention for an upper arm muscle exercising.
Figure 8:
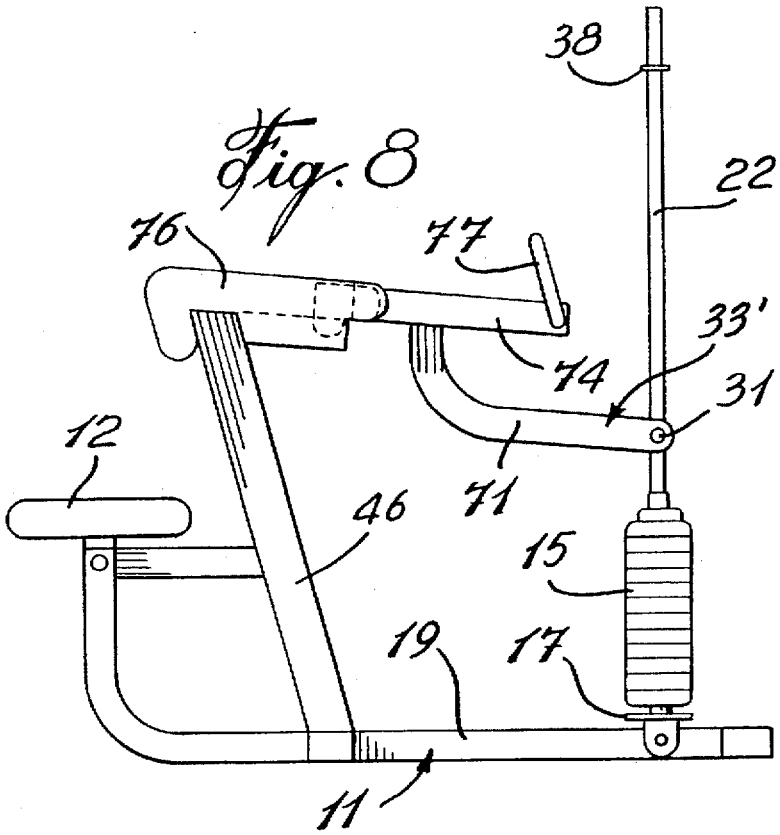
FIG. 8 is a side view of FIG. 7.
Figure 9:
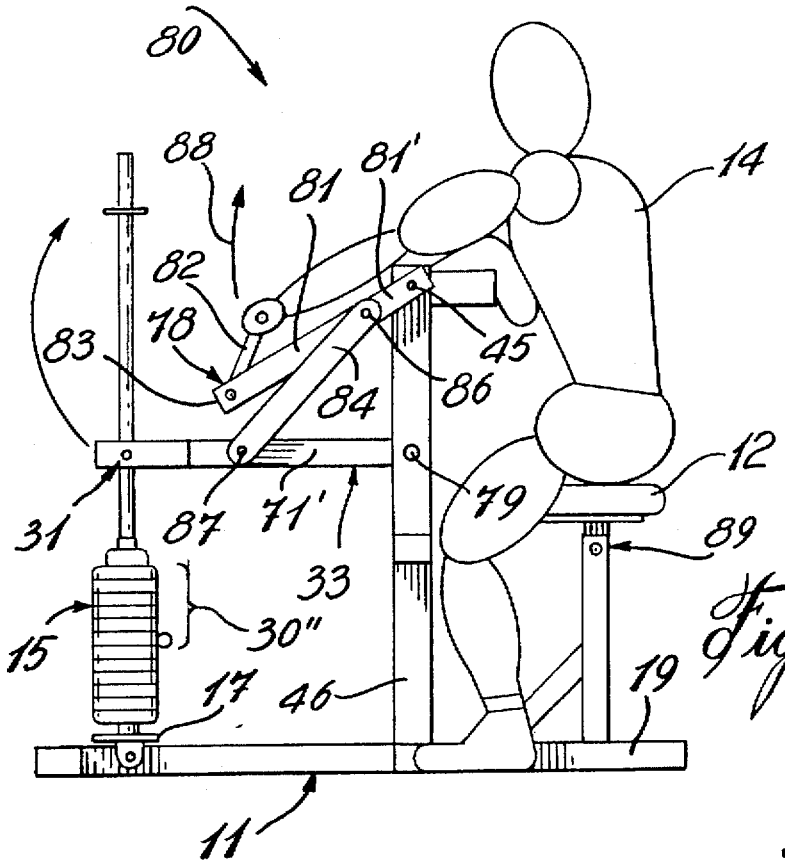
FIG. 9 is a side view of a modified version of the exercising machine of FIG. 7.

FIGS. 7, 8 and 9 show examples of an upper arm exercising machine 80. As hereinshown the pivoting exercising frame 33 consists of a single connecting arm 31 which is pivotally attached at a forward end to a pivotal connection 31' which instead of a block consists a U-shaped clasp 72 secured by pins 72' disposed on opposed sides of a tubular sleeve 73. Accordingly, this pivotal connection does not accommodate the restraining guide rods 22 but are maintained in parallel orientation by the end bracket 38, as previously described. The other end of the connecting arm 71 is welded to a straight frame member 74 which is pivoted at a rear end 75 to a pivot connection 45 as previously described. As shown, this pivot connection is integrated with an arm rest member 76 which is secured to the frame member 46. A seat 12 is disposed rearwardly of this armrest member and faces forwardly towards the weight stack 15. A handlebar 77 is connected to the straight frame element 74 of the connecting arm 71 and extends a predetermined distance forwardly of the arm rest 76 and is located between the weight stack 15 and the pivotal connection 45.

As can be seen in FIG. 9, the pivotal exercising frame 33 is a straight connecting arm 71' which is connected at a forward end to the pivotal connecting linkage 31 and at a rear end to an intermediate pivot connection 79. A double lever link frame 78 interconnects the pivotal arm 71' to the pivotal connection 45 which is disposed at the top of the frame member 46 and forwardly of the arm rest 76'. The double lever link frame 78 comprises a first link arm 81 which is pivotally secured at a rear end 81' to the pivotal connection 45. The swivel handlebar 82 is pivotally connected at 83 to a forward end of the link arm 81. A second link arm 84 pivotally connects at one end 85 to the first link arm 81 and is also pivotally connected by pivot connection 87, at an opposed end, to the pivotal arm 71' intermediate the pivot connection 79 and 31. When the user person 14 pulls on the handlebar 82, in the direction of arrow 88, the selected weight stack 30" is lifted and the pivotal connecting linkage 31 permits the tilting of the weight stack 15 on its pivoting support platform 17. The seat 12 may have an adjustable connection 89 to vary the height of the seat 12 above the base member 19.

The biceps curl exercise primarily works the biceps muscle of the upper arm also adding secondary stimulation to the forearms. The user person is in the seated position as shown in FIG. 9. The seat 12 adjusts to accommodate various heights. The swivel handles are grasped and the lever is pulled in an upright motion toward the user's chin area. This is the contracted position. The lever is then lowered and repeated through a number of repetitions. As shown in FIG. 9, the double linkage lever provides constant resistance because this is a short range movement. In addition, the double lever linkage 78 cuts down the angle of the weight stack travel.

Figure 10:
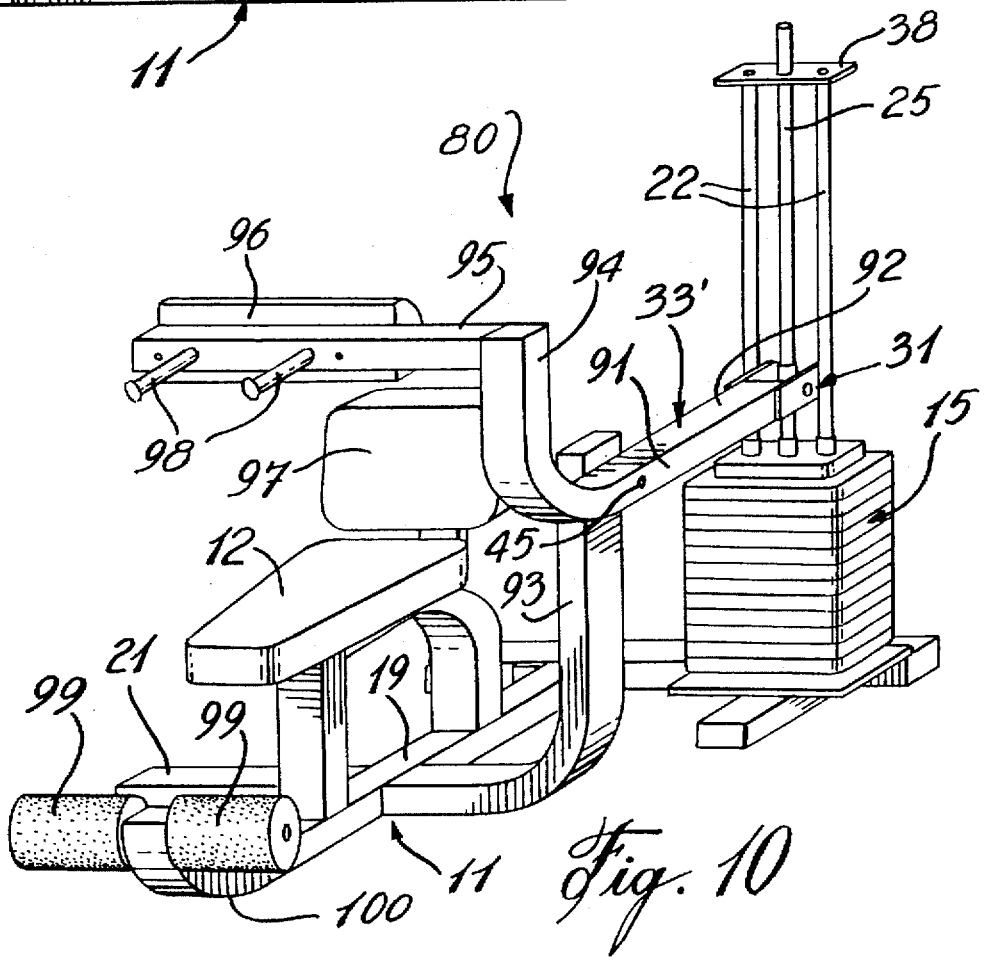
FIG. 10 is a perspective view of an exercising machine constructed in accordance with the present invention for abdominal muscle exercising.
Figure 11:
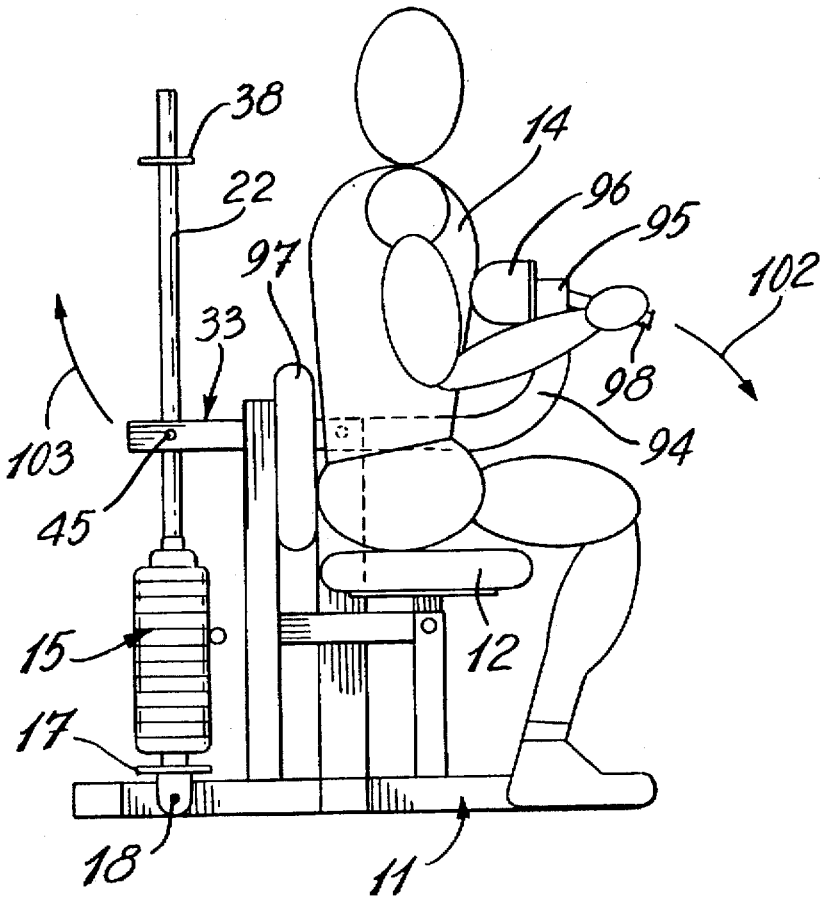
FIG. 11 is a simplified side view of the exercising machine of FIG. 10.

FIGS. 10 and 11 illustrate an abdominal muscle exercising machine 90 incorporating the present invention. As hereinshown the pivotal exercising frame 33 is comprised of an L-shaped connecting arm 91 which has a straight portion 92 pivotally connected by the pivotal connecting linkage 31 which is similar to that as described with reference to FIGS. 7 to 9. The pivotal exercising frame 33 has the pivotal connection 45 secured to a side frame member 93 secured to the support frame 11 and disposed to a side of the seat 12 and extending above the seat. The pivotal exercising frame 33 also has an upwardly extending forward portion 94 to which is secured a transverse connecting arm 95. An abdominal rest pad 96 is secured to the transverse frame member 95 and faces towards the backrest 97 which faces away from the weight stack 15 and disposed adjacent the seat 12. One or more handles 98 are secured to the transverse frame 95 and are disposed forwardly of the abdominal rest pad 96. Foot rest roller pads 99 may also be secured to an upwardly curved frontal portion 100 of the base member 19 of the frame 11 whereby to provide restraining support, in a similar manner to that as previously described with reference to FIG. 2.

As shown in FIG. 11, the user person 14 can therefore exercise his abdominal muscles by leaning forwardly against the abdominal rest pad 96, in the direction of arrow 102, thereby causing the pivotal connected rear end of the frame member 33 to move upwardly in the direction of arrow 103 while the pivot connections 44 and 18 compensate for the arcuate displacement of the rear portion of the frame member 33.

The abdominal crunch exercising machine 90 trains primarily the upper and middle region of the abdominals. The user person is place din the seated position locking the feet under the roller pads 99. The user then grasps the handles 98 and rest sits lower chest area against the upper pad 76'. The upper body then moves in a forward motion approximately 8 to 10 inches contracting the abdominals. The adjustable seat 12 allows for the pad 76' to conform to all heights.

It can be appreciated that the examples of the preferred embodiment described herein all relate to an exercising machine in which there is provided a direct drive to the weight stack 15. It provides a machine which is compact, easy to adjust and use and which does not utilize cables or pulleys. Accordingly, the machine is highly reliable and requires very little maintenance. Still further, the machine is easy to assemble and disassemble and results in ease of transportation. While maintaining its simplicity, it also provides ease of adjustability whereby to accommodate user persons of different physical stature.

It is within the ambit of the present invention to cover any obvious modifications of the examples of the preferred embodiment described herein, provided such examples fall within the scope of the appended claims.

I claim:

1. An exercising machine comprising a support frame having a seat to accommodate a user person, a weight stack having a plurality of predetermined weight elements guidingly connected to a pivoting support platform, restraining guide means secured to said pivoting support platform to permit said weight elements to be displaced therealong in a predetermined stack form, an elongated carrier means extending freely through said weight stack and having a plurality of attachment points along a prescribed length thereof, connection means to secure a selected one of said weight elements to one of said attachment points to form said predetermined stack, a pivotal connecting linkage secured to said carrier means and pivotally connected to a rear end portion of a pivoting exercising frame engageable by a user person to perform an exercise, said pivoting exercising frame having a pivotal connection to a stationary frame member intermediate said weight stack and said seat, said pivoting exercising frame further having a user engagement means in a front portion thereof, said predetermined stack being displaced along said restraining guide means during a pivoting displacement of said pivoting exercising frame about said pivotal connection while said pivoting support platform and pivotal connecting linkage pivot to accommodate an arcuate displacement of a rear end portion of said pivoting exercising frame when displaced about said pivotal connection, said pivotal connecting linkage being adjustably secured to a selected one of said attachment points whereby to adjust the pivotal angle of said pivoting exercising frame to position said user engagement means of said exercising frame at a desired position relative to said seat to adapt said exercise machine to a particular user person, said pivotal connecting linkage being comprised of a connecting block pivotally connected at opposed ends thereof between parallel frame members secured to said rear end portion of said pivoting exercising frame and said elongated carrier means which is an elongated rod extending freely through aligned apertures of said plurality of predetermined weight elements, said elongated rod having a plurality of equidistantly spaced holes therein constituting said attachment points, said connecting block having a rod receiving aperture through which said elongated carrier means extends, a locking pin bore in a side wall of said block and extending to said rod receiving aperture, a locking pin to engage said block within a selected one of said spaced holes, and one or more guide holes for receiving therethrough one or more restraining rods which are secured at a lower end to said pivoting support platform and which extend through respective aligned guide holes provided in said weight elements of said stack, said restraining rods constituting said restraining guide means, said pivotal connection being disposed at opposed ends of said block said user engagement means comprising a pair of spaced apart arms extending substantially parallel to one another on respective sides of said seat.

2. An exercising machine as claimed in claim 1 wherein said weight elements are metal discs, each said disc having a through bore in a side wall thereof and extending to said aperture thereof, said connecting means further comprising a connecting pin extending through said through bore of said selected one of said discs and into an adjacent one of said equidistantly spaced holes of said elongated rod.

3. An exercising machine as claimed in claim 1 wherein said weight stack is located at a rear of said support frame and said seat at a front of said support frame, said user engagement means further comprising a handle secured adjacent said one end and disposed at a predetermined position on respective sides of said seat.

4. An exercising machine as claimed in claim 3 wherein said seat has a rearwardly inclined backrest, said exercising machine being a triceps muscle exercising machine.

5. An exercising machine as claimed in claim 1 wherein said pivoting exercising frame is connected directly to said weight stack by pivotal connections and without the use of cables and pulleys.

6. An exercising machine as claimed in claim 5 wherein said seat is a stationary seat.

* * * * *